US005797516A

United States Patent [19]

Brandl

[11] Patent Number: 5,797,516

[45] Date of Patent: Aug. 25, 1998

[54] FILLING DEVICE FOR THE PROPORTIONED DELIVERY OF VERY VISCOUS MATERIALS

[75] Inventor: Franz Brandl, St. Martin, Austria

[73] Assignee: Ludwig Schwerdtel GmbH, Karlsfeld, Germany

[21] Appl. No.: 774,637

[22] Filed: Dec. 30, 1996

[51] Int. Cl.[6] ..... B65B 3/00

[52] U.S. Cl. ..... 222/80; 222/504; 141/250; 141/264

[58] Field of Search ..... 141/250, 255, 141/264; 222/80, 504, 505, 548, 549, 559; 83/307.3

[56] References Cited

U.S. PATENT DOCUMENTS

| | | | |
|---|---|---|---|
| 1,458,282 | 6/1923 | Fairbanks | 222/80 |
| 1,523,122 | 1/1925 | Hellmann | 222/80 |
| 3,140,806 | 7/1964 | Schwertfeger et al. | 222/80 |
| 3,851,554 | 12/1974 | Papai | 222/80 |
| 4,419,790 | 12/1983 | Niedecker | 141/250 |
| 4,445,548 | 5/1984 | Neumann | 141/264 |
| 5,095,955 | 3/1992 | Barnewitz et al. | 141/264 |
| 5,127,549 | 7/1992 | Merritt al. | 222/80 |
| 5,495,962 | 3/1996 | Nomura | 222/80 |

*Primary Examiner*—J. Casimer Jacyna
*Attorney, Agent, or Firm*—Browdy and Neimark

[57] ABSTRACT

A filling device for the proportioned delivery of very viscous materials comprises a filling pipe with a material outlet end in the vicinity of a front. At the outlet end, provision is made for a cutting head, which is rotatable relative to the filling pipe about a common central longitudinal axis. A cutting knife, which preferably consists of a spring steel wire, is disposed detachably and replaceably on the cutting head.

36 Claims, 5 Drawing Sheets

FILLING DEVICE FOR THE PROPORTIONED DELIVERY OF VERY VISCOUS MATERIALS

BACKGROUND OF THE INVENTION

1. Field of the Invention

The invention relates to a filling device for the proportioned delivery of very viscous materials, which are preferably silicone-based sealing compounds.

2. Background Art

Filling devices of the generic type are disposed for instance downstream of proportioning apparatuses as they are specified in U.S. Pat. No. 4,693,397. These filling devices serve to fill for instance cartridges disposed on arrangements, as known from U.S. Pat. No. 4,874,022. In practice, these filling devices have cut-off devices which exhibit a straight wire soldered on a front of a rotary pipe that surrounds the filling pipe. After termination of the filling job, the rotary pipe comprising the wire that forms a cutting knife is rotated about the common central longitudinal axis of the filling pipe and the rotary pipe, the strand of the very viscous material forced into a cartridge thereby being severed. These cutting knives formed by a wire are subject to high wear. Renewing a worn-out wire that serves as a cutting knife is very difficult, since fixing is only possible by hard soldering. Moreover, length adjustment relative to the filling pipe of the rotary pipe, which comprises the wire serving as a cutting knife, is difficult.

SUMMARY OF THE INVENTION

It is the object of the invention to embody a filling device of the generic type such that renewal of the worn-out cutting knife is easily feasible.

According to the invention, this object is attained by the following features: a filling pipe having a material outlet end in the vicinity-of a front; a cutting head, which is disposed at the outlet end and rotatable relative to the filling pipe about a common central longitudinal axis, and on which a cutting knife is mounted tightly, but detachably and replaceably, in the direction of the axis and radially and tangentially thereto. The gist of the invention resides in that the cutting knife is made detachable and replaceable by being fixed by positive fit only.

Further features, advantages and details of the invention will become apparent from the description of exemplary embodiments, taken in conjunction with the drawing.

DESCRIPTION OF THE PREFERRED EMBODIMENTS

Figure 1:
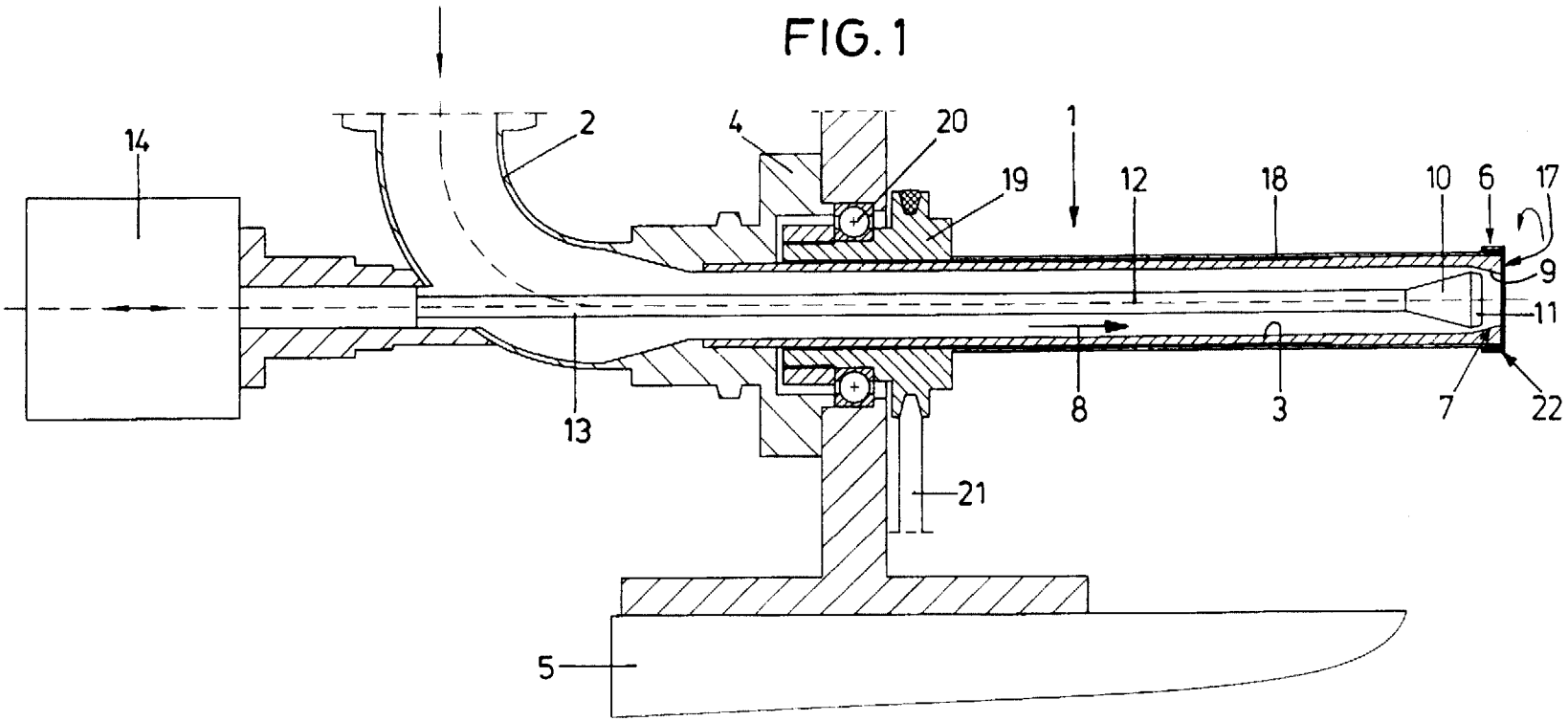
FIG. 1 is a longitudinal section of a filling device.

FIG. 1 illustrates a filling device 1, which has a feeder neck 2. The latter is connected to an outlet of a proportioning apparatus for very viscous materials, for instance sealing compounds. Proportioning apparatuses of this type are illustrated and specified in U.S. Pat. No. 4,693,397. The filling device 1 serves to fill cartridges on a cartridge-filling and closing machine as known for instance from U.S. Pat. No. 4,874,022.

Figures 2, 3, 4, 5:
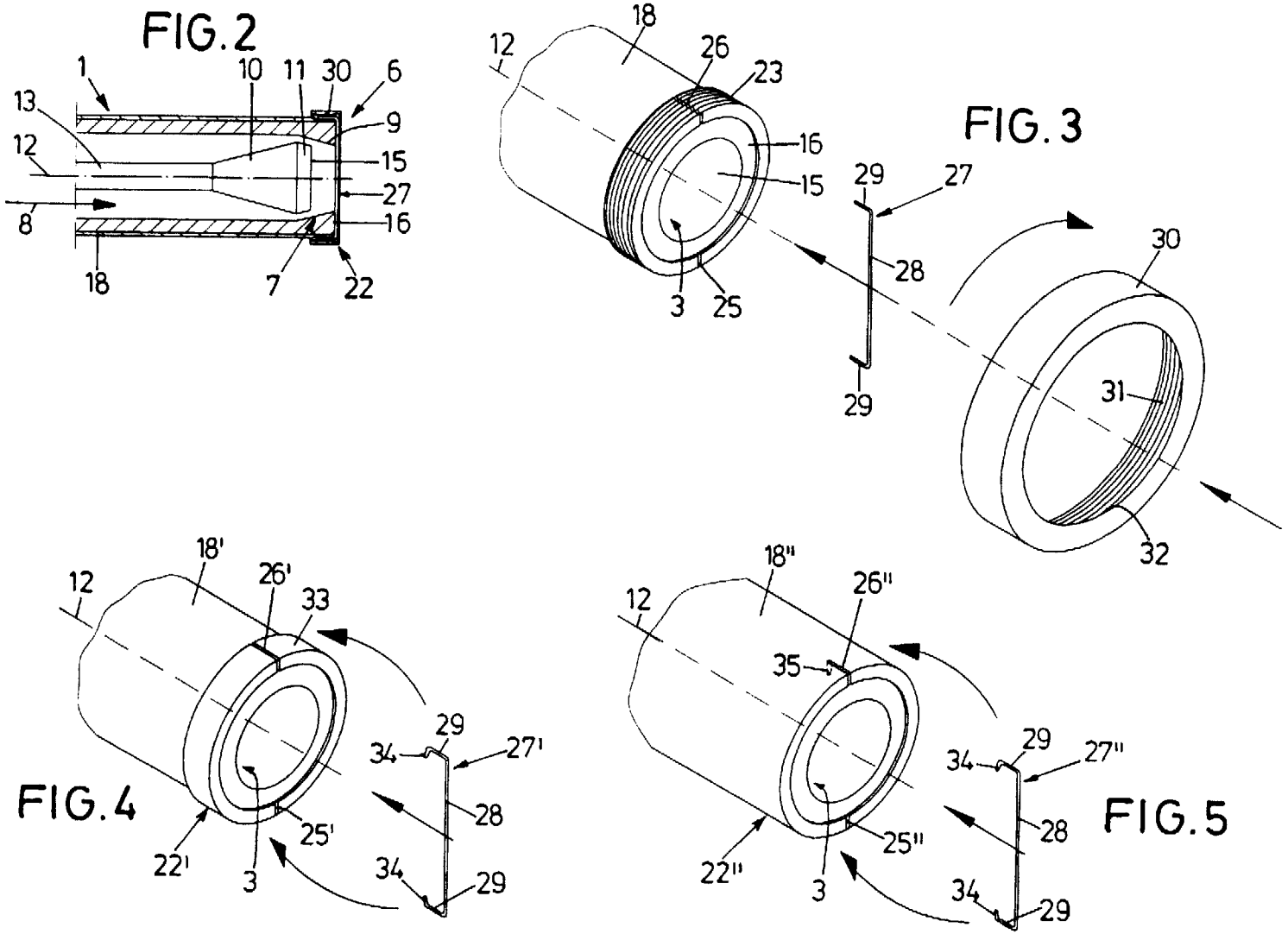
FIG. 2 is another longitudinal section of the portion of the filling device in proximity to the latter's outlet end.
FIG. 3 is a perspective exploded view of the filling device according to FIGS. 1 and 2 in the vicinity of the outlet end.
FIG. 4 is a perspective exploded view of a second embodiment.
FIG. 5 is a perspective exploded view of a third embodiment.

The filling device 1 comprises a filling pipe 3 which is connected to the curved feeder neck 2. The feeder neck 2 and the filling pipe 3 are held in a flange 4 fastened on a machine frame 5, which may also carry the proportioning apparatus in question. At its material outlet end 6, the stationary and non-rotatable filling pipe 3 of the embodiment according to FIG. 1 is provided with an outlet valve 7 shown on an enlarged scale in FIG. 2. It has a valve face 9 tapering in the material conveying direction 8 and a valve block 10, which comprises a sealing face 11 suited to the valve face 9. The valve block 10 is mounted on a valve tappet 13, which is disposed concentrically of the central longitudinal axis 12 of the filling pipe 3 and which can be actuated by means of a pressure-medium-actuated linear drive 14. In FIGS. 1 and 2 the outlet valve 7 is opened. When the valve block 10 is moved in the material conveying direction 8, as a result of which the outlet valve 7 is closed, the front 15 of the valve head 10 is in alignment with the front 16 of the filling pipe 3 at the latter's outlet end 6.

The filling pipe 3 is surrounded by a cut-off device 17, which comprises a rotary pipe 18 concentrically enveloping the filling pipe 3. The rotary pipe 18 is non-rotatably mounted on a V-belt pulley 19, which, by means of a bearing 20, is lodged non-displaceably, but rotatably in the machine frame 5, and which, by means of a V-belt 21, can be driven in rotation by a drive motor (not shown).

At its end allocated to the material outlet end 6, the rotary pipe 18 is provided with a cutting head 22, various embodiments of which will be specified below.

In the embodiment according to FIGS. 1, 2 and 3, the rotary pipe 18 is provided with an external thread 23. On its front 24, the rotary pipe 18 is provided with two radial grooves 25, which run diametrically to the axis 12 and extend as far as to the front 16 of the filling pipe 3. These radial grooves 25 are followed by longitudinal grooves 26, which run parallel to the axis 12 and which pass through the external thread 23 as far as below the latter's root.

A wire serving as a cutting knife 27 is placed into the grooves 25, 26, this wire exhibiting a straight cutting section 28 and radial tangential holding sections 29 bent at right angles. The radial tangential holding sections 29 are slipped into the longitudinal grooves 26. In this case, the extreme end portions of the cutting section 28 reach into the radial grooves 25. Then a threaded ring 30 with an internal thread 31 is screwed on the external thread 23, the cutting knife 27 thus being arrested in the direction of the axis 12 radially thereto and tangentially thereto. In the direction of the axis 12, namely in the material conveying direction 8, the cutting knife 27 is retained by a small annular collar 32 on the threaded ring 30. The straight cutting section 28 of the cutting knife 27 rests on the front 16 of the filling pipe 3 and on the front 15 of the valve block 10 when the outlet valve 7 is closed.

When a cartridge which projects into the filling pipe 3 during the filling operation is filled with the material, then the outlet valve 7 is closed and the cut-off device 17 is actuated by rotation of the rotary pipe 18. As a result, the very viscous material is cut off at the flush fronts 16, 15 of the filling pipe 3 and the valve block 10. The material filled into the cartridge exhibits a smooth surface without the wall portions being smeared. The material outlet end 6 of the filling device 1 is not smeared either. In the case of cartridges of varying diameters, only the threaded ring 30 has to be changed. Everything else can remain unchanged. When the cutting knife 27, which consists of spring steel wire as a rule, is worn out, it can be replaced very easily, since only the threaded ring 30 has to be screwed off and another cutting knife 27 has to be inserted.

The ensuing description of further exemplary embodiments only deals with differences in relation to the first embodiment.

In the embodiment according to FIG. 4, a rotary pipe 18' is provided with a cutting head 22' substantially formed by an annular collar 33, which is integral with the rotary pipe 18' and which is provided with diametrically arranged radial grooves 25' and longitudinal grooves 26' running parallel to the axis 12. In addition to the straight cutting section 28 and the radial tangential holding sections 29 bent at right angles, the cutting knife 27' further has axial holding sections 34 bent parallel to the cutting section 28 inwards from the holding sections 29. These axial holding sections 34 come to rest behind the annular collar 33 or in grooves formed there. The cutting knife 27' of spring steel wire is slipped over the annular collar 33 by elastic expansion of the radial tangential holding sections 29, the axial holding sections 34 being pushed through the longitudinal grooves 26'. In this case, too, replacing the cutting knife 27 is very easily possible. The cutting section 28 lies flush in the radial grooves 25', i.e. it does not project over the face of the annular collar 33.

In the embodiment according to FIG. 5, the cutting head 22" is formed on the rotary pipe 18" in such a way that the radial grooves 25" and the longitudinal grooves 26" are formed on the rotary pipe 18" itself and that at the end of the longitudinal grooves 26", radial holes 35 are provided in the rotary pipe 18", with which engage the axial holding sections 34 of the cutting knife 27" which is otherwise identical with the cutting knife 27'. Installation and removal of the cutting knife 27" take place in the same way as with the cutting knife 27' of the embodiment according to FIG. 4.

Figure 7:
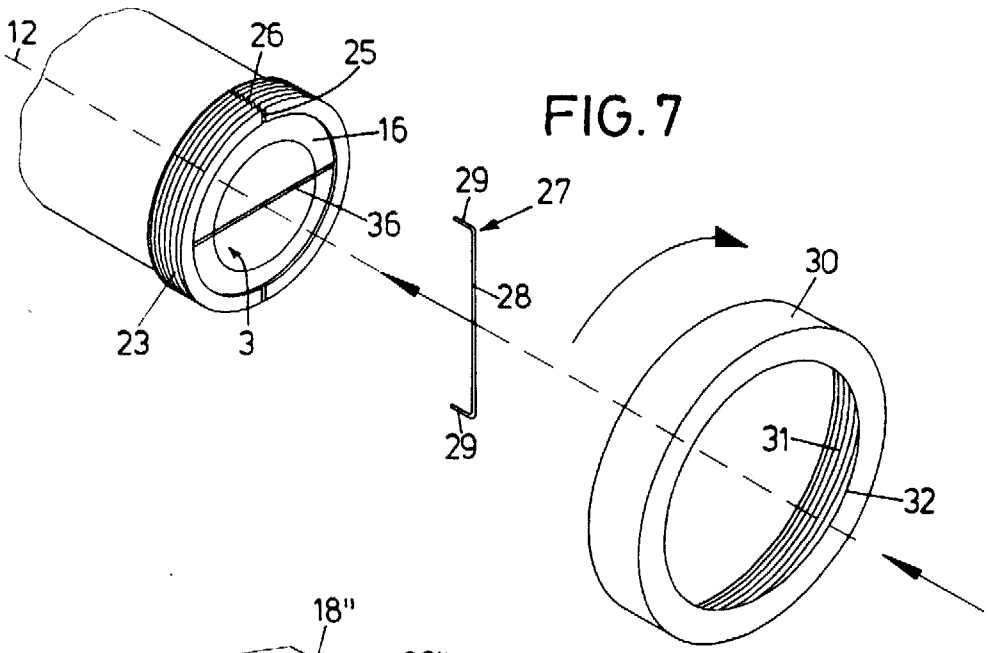
FIG. 7 is a perspective exploded view of the fourth embodiment according to FIG. 6.
Figure 6:
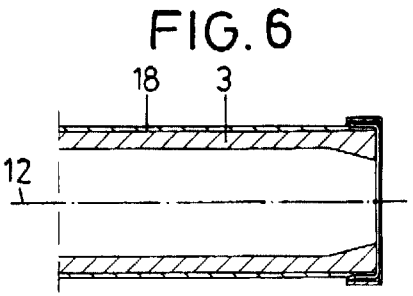
FIG. 6 is a longitudinal section of a fourth embodiment.

The embodiment according to FIGS. 6 and 7 corresponds to that of FIGS. 2 and 3 with the difference that no outlet valve 7 is provided. While the fronts 16 and 15 of the filling pipe 3 and the valve block 10 work as opposite knives for the cutting knife 27 in the embodiment according to FIGS. 2 and 3, the embodiment according to FIGS. 6 and 7 provides for an opposite knife 36 in the form of a straight spring steel wire embedded in the front 16 of the filling pipe 3. Since the design is otherwise unmodified, the same reference numerals are used as in FIGS. 2 and 3, there being no need of renewed description.

Figure 9:
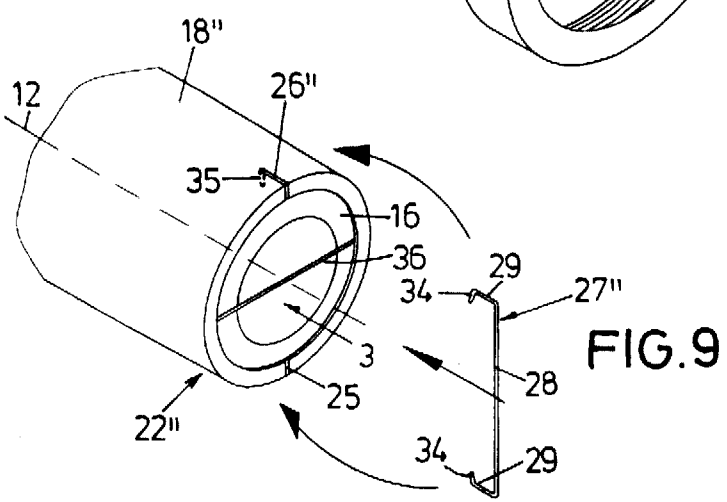
FIG. 9 is a perspective exploded view of a sixth embodiment.
Figure 8:
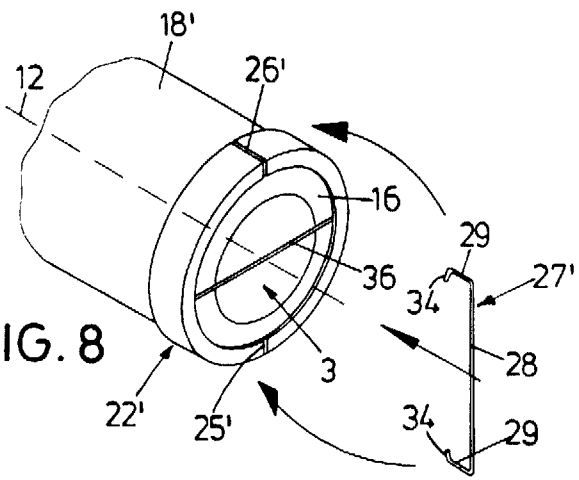
FIG. 8 is a perspective exploded view of a fifth embodiment.

The embodiments according to FIGS. 8 and 9 correspond to those according to FIGS. 4 and 5 with the only exception that again no outlet valve is provided at the material outlet end 6. An opposite knife 36 is embedded in the front 16 of the filling pipe 3, cooperating with the cutting knife 27' and 27", respectively.

Figure 11:
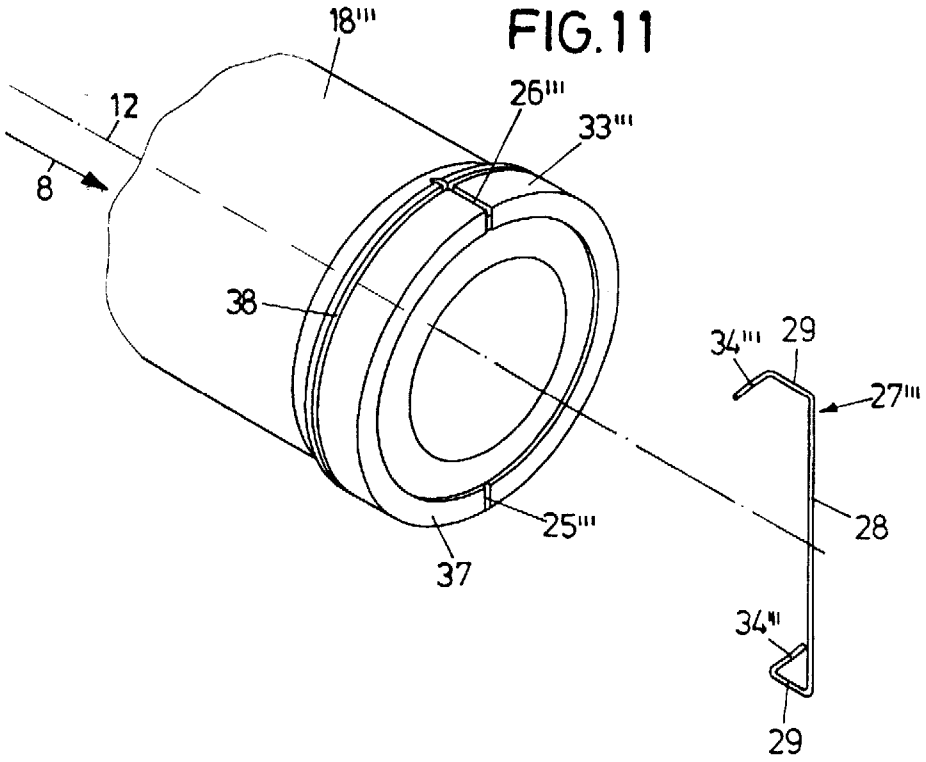
FIG. 11 is a perspective exploded view of the seventh embodiment.
Figure 10:
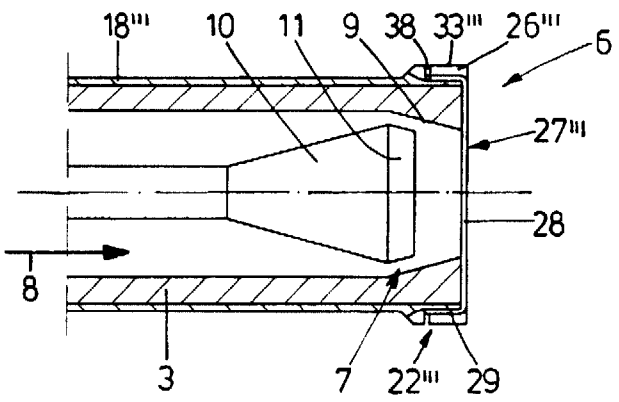
FIG. 10 is a longitudinal section of an especially preferred seventh embodiment.

FIGS. 10 and 11 illustrate an especially preferred embodiment, coming comparatively near the embodiment according to FIG. 4. Again an outlet valve 7 is provided. For the fastening of a cutting knife 27'", an annular collar 33'" is integrally formed on the rotary pipe 18'" in vicinity to the material outlet end 6. This annular collar 33'" has radial grooves 25'" on its front 37 and longitudinal grooves 26'" on its outside, which run parallel to the axis 12. Moreover, an annular groove 38 is formed in the front portion—referred to the conveying direction 8—of the annular collar 33'", the longitudinal grooves 26'" opening into this annular groove 38. The cutting knife 27'" has a cutting section 28 and radial tangential holding sections 29. These are followed by axial holding sections 34'" which are tangential to the axis 12 and extend counter to the direction of rotation. The cutting knife 27'" is elastically snapped on the annular collar 33'", as described in connection with FIGS. 4 and 5. Then the axial holding sections 34'" engage with the annular groove 38, axially securing the cutting knife 27'" against working loose from the cutting head 22'" in the conveying direction 8.

Figure 13:
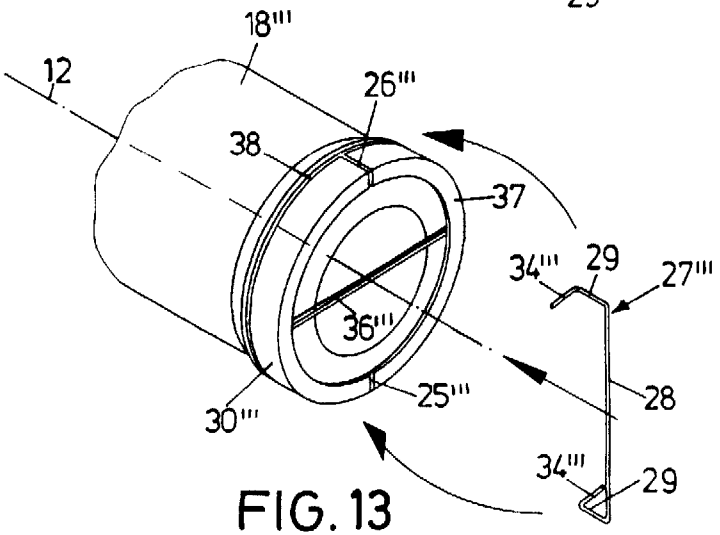
FIG. 13 is a perspective exploded view of the eighth embodiment.
Figure 12:
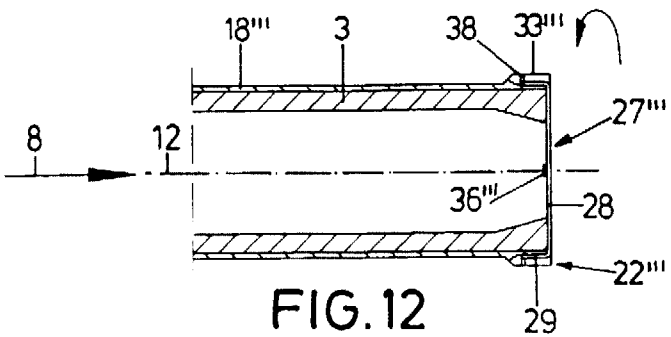
FIG. 12 is a longitudinal section of an eighth embodiment.

The embodiment according to FIGS. 12 and 13 differs from that according to FIGS. 10 and 11 substantially in that no outlet valve is provided. Again an opposite knife 36'" is inserted on the front 16 of the filling pipe 3, which may consist of a spring steel wire, which however must not forcibly be a wire, but can for instance be of flat material. The knife is embedded in the front 16 to such an extent that it is flush with the cutting section 28 of the cutting knife 27'".

Figure 15:
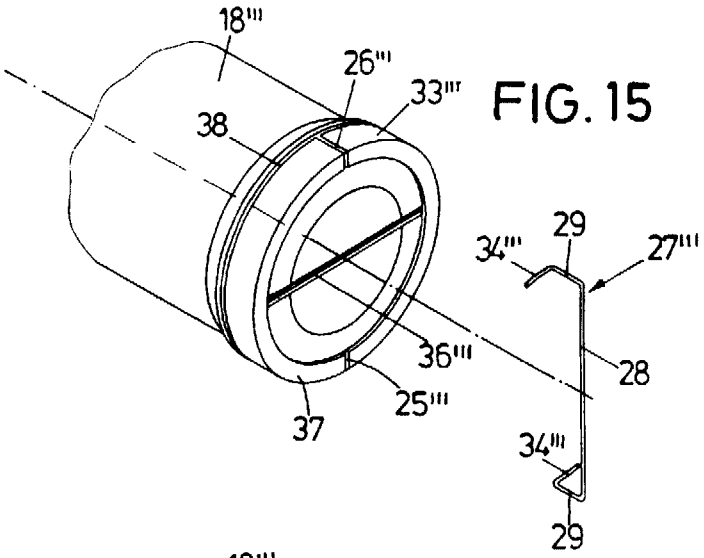
FIG. 15 is a perspective exploded view of the ninth embodiment.
Figure 14:
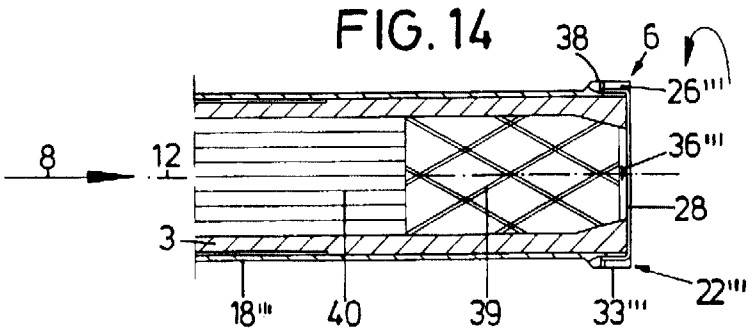
FIG. 14 is a longitudinal section of a ninth embodiment.

The embodiment according to FIGS. 14 and 15 differs from that according to FIGS. 12 and 13 only in that so-called static mixing inserts 39, 40 are disposed in the filling pipe 3, subjecting the material to an intense mixing process. Inserts of this type are known for instance from GB 20 61 746 B.

What is claimed is:

1. A filling device for the proportioned delivery of very viscous materials, comprising the following features:

a filling pipe (3) having a material outlet end (6) in the vicinity of a front (16) and a central longitudinal axis (12), a cutting head (22, 22', 22", 22'"), which is disposed at the material outlet end (6), and which is rotatable relative to the filling pipe (3) about said central longitudinal axis (12), and on which a cutting knife (27, 27', 27", 27'") is mounted tightly, but detachably and replaceably, in the direction of said central longitudinal axis (12) and radially thereto and tangentially to said cutting head (22, 22', 22", 22'"), wherein the cutting head (22, 22', 22", 22'") is provided with radial grooves (25, 25', 25", 25'") extending radially to said central longitudinal axis (12), and wherein the cutting knife (27, 27', 27", 27'") is arrested in said radial grooves (25, 25', 25", 25'"), and wherein the cutting knife (27, 27', 27", 27,'") is provided with bent off, radial tangential holding sections (29), wherein the cutting head (22, 22', 22", 22'") is provided with longitudinal grooves (26, 26', 26", 26'") extending parallel to said central longitudinal axis (12), and wherein said holding sections (29) are arrested in said longitudinal grooves (26, 26', 26", 26'").

2. A filling device according to claim 1, wherein the cutting knife (27', 27", 27'") is provided with bent off axial holding sections (34, 34'"), which are arrested on said cutting head (22', 22", 22'").

3. A filling device according to claim 2, wherein said cutting head (22') is provided with holes (35) radial to said central longitudinal axis (12), and wherein said axial holding sections (34) are directed inwards radially to said central longitudinal axis (12) and engage with said holes (35).

4. A filling device according to claim 2, wherein said cutting head (22'") is provided with at least one tangential groove (38), and wherein at least one axial holding section (34") extends tangentially to said central longitudinal axis (12) and engages with said at least one tangential groove (38).

5. A filling device according to claim 1, wherein the cutting knife (27) is arrested on the cutting head (22) by means of a threaded ring (30).

6. A filling device according to claim 1, wherein the cutting knife (27, 27', 27", 27'") is provided with bent off, radial tangential holding sections (29), wherein the cutting head (22, 22', 22", 22'") is provided with longitudinal grooves (26, 26', 26", 26'") extending parallel to said central longitudinal axis (12), wherein said holding sections (29) are arrested in said longitudinal grooves (26, 26', 26", 26'"), and wherein the radial grooves (25', 25'") and the longitudinal grooves (26', 26'") are formed in an annular collar (33, 33'") of the cutting head (22', 22'").

7. A filling device according to claim 1, wherein a front (15) of an outlet valve (7) allocated to the front (16) of the filling pipe (3) forms an opposite surface for the cutting knife (27, 27', 27").

8. A filling device according to claim 1, wherein an opposite knife (36) is disposed on the front (16) of the filling pipe (3).

9. A filling device according to claim 1, wherein the cutting knife (27, 27', 27", 27'") consists of a spring steel wire.

10. A filling device for the proportioned delivery of very viscous materials, comprising the following features:

a filling pipe (3) having a material outlet end (6) in the vicinity of a front (16) and a central longitudinal axis (12), a cutting head (22, 22', 22", 22'"), which is disposed at the material outlet end (6), and which is rotatable relative to the filling pipe (3) about said central longitudinal axis (12), and on which a cutting knife (27, 27', 27", 27'") is mounted tightly, but detachably and replaceably, in the direction of said central longitudinal axis (12) and radially thereto and tangentially to said cutting head (22, 22', 22", 22'"), wherein the cutting knife (27) is arrested on the cutting head (22) by means of a threaded ring (30).

11. A filling device according to claim 10, wherein the cutting head (22, 22', 22", 22'") is provided with radial grooves (25, 25', 25", 25'") extending radially to said central longitudinal axis (12), and wherein the cutting knife (27, 27', 27", 27'") is arrested in said radial grooves (25, 25', 25", 25'").

12. A filling device according to claim 10, wherein the cutting knife (27, 27', 27", 27'") is provided with bent off, radial tangential holding sections (29), wherein the cutting head (22, 22', 22", 22'") is provided with longitudinal grooves (26, 26', 26", 26'") extending parallel to said central longitudinal axis (12), and wherein said holding sections (29) are arrested in said longitudinal grooves (26, 26', 26", 26'").

13. A filling device according to claim 10, wherein the cutting knife (27', 27", 27'") is provided with bent off axial holding sections (34, 34'"), which are arrested on said cutting head (22', 22", 22'").

14. A filling device according to claim 13, wherein said cutting head (22') is provided with holes (35) radial to said central longitudinal axis (12), and wherein said axial holding sections (34) are directed inwards radially to said central longitudinal axis (12) and engage with said holes (35).

15. A filling device according to claim 13, wherein said cutting head (22'") is provided with at least one tangential groove (38), and wherein at least one axial holding section (34") extends tangentially to said central longitudinal axis (12) and engages with said at least one tangential groove (38).

16. A filling device according to claim 10, wherein a front (15) of an outlet valve (7) allocated to the front (16) of the filling pipe (3) forms an opposite surface for the cutting knife (27, 27', 27").

17. A filling device according to claim 10, wherein an opposite knife (36) is disposed on the front (16) of the filling pipe (3).

18. A filling device according to claim 10, wherein the cutting knife (27, 27', 27", 27'") consists of a spring steel wire.

19. A filling device for the proportioned delivery of very viscous materials, comprising the following features:

a filling pipe (3) having a material outlet end (6) in the vicinity of a front (16) and a central longitudinal axis (12), a cutting head (22, 22', 22", 22'"), which is disposed at the material outlet end (6), and which is rotatable relative to the filling pipe (3) about said central longitudinal axis (12), and on which a cutting knife (27, 27', 27", 27'") is mounted tightly, but detachably and replaceably, in the direction of said central longitudinal axis (12) and radially thereto and tangentially to said cutting head (22, 22', 22", 22'"), wherein the cutting head (22, 22', 22", 22'") is provided with radial grooves (25, 25', 25", 25'") extending radially to said central longitudinal axis (12), and wherein the cutting knife (27, 27', 27", 27'") is arrested in said radial grooves (25, 25', 25", 25'"), and wherein the cutting knife (27, 27', 27", 27'") is provided with bent off, radial tangential holding sections (29), wherein the cutting head (22, 22', 22", 22'") is provided with longitudinal grooves (26, 26', 26", 26'") extending parallel to said central longitudinal axis (12), wherein said holding sections (29) are arrested in said longitudinal grooves (26, 26', 26", 26'"), and wherein the radial grooves (25', 25'") and the longitudinal grooves (26', 26'") are formed in an annular collar (33, 33'") of the cutting head (22', 22'").

20. A filling device according to claim 19, wherein the cutting knife (27, 27', 27", 27'") is provided with bent off, radial tangential holding sections (29), wherein the cutting head (22, 22', 22", 22'") is provided with longitudinal grooves (26, 26', 26", 26'") extending parallel to said central longitudinal axis (12), and wherein said holding sections (29) are arrested in said longitudinal grooves (26, 26', 26", 26'").

21. A filling device according to claim 19, wherein the cutting knife (27', 27", 27'") is provided with bent off axial holding sections (34, 34'"), which are arrested on said cutting head (22', 22", 22'").

22. A filling device according to claim 21, wherein said cutting head (22') is provided with holes (35) radial to said central longitudinal axis (12), and wherein said axial holding sections (34) are directed inwards radially to said central longitudinal axis (12) and engage with said holes (35).

23. A filling device according to claim 21, wherein said cutting head (22'") is provided with at least one tangential groove (38), and wherein at least one axial holding section (34") extends tangentially to said central longitudinal axis (12) and engages with said at least one tangential groove (38).

24. A filling device according to claim 19, wherein a front (15) of an outlet valve (7) allocated to the front (16) of the filling pipe (3) forms an opposite surface for the cutting knife (27, 27', 27").

25. A filling device according to claim 19, wherein an opposite knife (36) is disposed on the front (16) of the filling pipe (3).

26. A filling device according to claim 19, wherein the cutting knife (27, 27', 27", 27'") consists of a spring steel wire.

27. A filling device for the proportioned delivery of very viscous materials, comprising the following features:

a filling pipe (3) having a material outlet end (6) in the vicinity of a front (16) and a central longitudinal axis (12), a cutting head (22, 22', 22", 22'"), which is disposed at the material outlet end (6), and which is rotatable relative to the filling pipe (3) about said central longitudinal axis (12), and on which a cutting knife (27, 27', 27", 27'") is mounted tightly, but detachably and replaceably, in the direction of said central longitudinal axis (12) and radially thereto and tangentially to said cutting head (22, 22', 22", 22'"), wherein the cutting knife (27, 27', 27", 27'") consists of a spring steel wire.

28. A filling device according to claim 27, wherein the cutting head (22, 22', 22", 22'") is provided with radial grooves (25, 25', 25", 25'") extending radially to said central longitudinal axis (12), and wherein the cutting knife (27, 27', 27", 27'") is arrested in said radial grooves (25, 25', 25", 25'").

29. A filling device according to claim 28, wherein the cutting knife (27, 27', 27", 27'") is provided with bent off, radial tangential holding sections (29), wherein the cutting head (22, 22', 22", 22'") is provided with longitudinal grooves (26, 26', 26", 26'") extending parallel to said central longitudinal axis (12), wherein said holding sections (29) are arrested in said longitudinal grooves (26, 26', 26", 26'"), and wherein the radial grooves (25', 25'") and the longitudinal grooves (26', 26'") are formed in an annular collar (33, 33'") of the cutting head (22', 22'").

30. A filling device according to claim 29, wherein the cutting knife (27, 27', 27", 27'") is provided with bent off, radial tangential holding sections (29), wherein the cutting head (22, 22', 22", 22'") is provided with longitudinal grooves (26, 26', 26", 26'") extending parallel to said central longitudinal axis (12), and wherein said holding sections (29) are arrested in said longitudinal grooves (26, 26', 26", 26'").

31. A filling device according to claim 29, wherein the cutting knife (27', 27", 27'") is provided with bent off axial holding sections (34, 34'"), which are arrested on said cutting head (22', 22", 22'").

32. A filling device according to claim 31, wherein said cutting head (22') is provided with holes (35) radial to said central longitudinal axis (12), and wherein said axial holding sections (34) are directed inwards radially to said central longitudinal axis (12) and engage with said holes (35).

33. A filling device according to claim 32, wherein said cutting head (22'") is provided with at least one tangential groove (38), and wherein at least one axial holding section (34") extends tangentially to said central longitudinal axis (12) and engages with said at least one tangential groove (38).

34. A filling device according to claim 27, wherein the cutting knife (27) is arrested on the cutting head (22) by means of a threaded ring (30).

35. A filling device according to claim 27, wherein a front (15) of an outlet valve (7) allocated to the front (16) of the filling pipe (3) forms an opposite surface for the cutting knife (27, 27', 27").

36. A filling device according to claim 27, wherein an opposite knife (36) is disposed on the front (16) of the filling pipe (3).

* * * * *